US008506460B2

(12) United States Patent
Seitzer

(10) Patent No.: US 8,506,460 B2
(45) Date of Patent: Aug. 13, 2013

(54) EXERCISE APPARATUS FOR EXERCISING

(75) Inventor: James K. Seitzer, Columbus, OH (US)

(73) Assignee: James K. Seitzer, Columbus, OH (US)

( * ) Notice: Subject to any disclaimer, the term of this patent is extended or adjusted under 35 U.S.C. 154(b) by 0 days.

(21) Appl. No.: 13/435,670

(22) Filed: Mar. 30, 2012

(65) Prior Publication Data

US 2013/0012366 A1 Jan. 10, 2013

Related U.S. Application Data

(63) Continuation of application No. 12/771,506, filed on Apr. 30, 2010, now abandoned, which is a continuation of application No. 11/941,660, filed on Nov. 16, 2007, now abandoned.

(51) Int. Cl.

| | |
|---|---|
| ***A63B 21/072*** | (2006.01) |
| ***A63B 21/075*** | (2006.01) |
| ***A63B 21/22*** | (2006.01) |
| ***A63B 21/02*** | (2006.01) |

(52) U.S. Cl.
USPC ..... 482/106; 482/110; 482/121

(58) Field of Classification Search
USPC ..... 482/92–94, 97–99, 104, 106–110, 482/121–126, 129–130; D21/679–682, 692–693
See application file for complete search history.

(56) References Cited

U.S. PATENT DOCUMENTS

| | | | | |
|---|---|---|---|---|
| 3,290,044 | A * | 12/1966 | Krodsen et al. | 482/94 |
| 4,111,415 | A | 9/1978 | Reitano | |
| 4,618,142 | A | 10/1986 | Joseph, Jr. | |
| 4,669,451 | A | 6/1987 | Blauth et al. | |
| 4,890,831 | A | 1/1990 | Craig | |
| 5,013,036 | A | 5/1991 | Anchia | |
| 5,029,849 | A * | 7/1991 | Nurkowski | 482/106 |
| 5,230,682 | A | 7/1993 | Myers | |
| 5,250,014 | A | 10/1993 | Chang | |
| 5,282,777 | A | 2/1994 | Myers | |
| 5,352,174 | A | 10/1994 | Mason et al. | |
| 5,421,797 | A | 6/1995 | Fletcher | |
| 5,531,657 | A | 7/1996 | Macedo | |
| 5,573,487 | A | 11/1996 | Wallner | |
| 5,643,161 | A | 7/1997 | Gordon | |
| 5,653,665 | A | 8/1997 | Neeley | |
| 5,674,162 | A | 10/1997 | Ellingson et al. | |
| 5,674,166 | A | 10/1997 | Gordon | |
| 5,846,170 | A | 12/1998 | Ho | |
| 5,891,004 | A * | 4/1999 | Berry | 482/129 |
| 5,945,060 | A | 8/1999 | Williams | |
| 6,010,436 | A * | 1/2000 | Obery et al. | 482/93 |
| 6,024,679 | A | 2/2000 | Castallanos et al. | |
| 6,540,651 | B1 | 4/2003 | Aberton et al. | |
| 6,620,117 | B1 | 9/2003 | Johnson et al. | |
| 2007/0032355 | A1 | 2/2007 | DiGiacomo | |
| 2008/0096738 | A1 | 4/2008 | Kim | |

* cited by examiner

*Primary Examiner* — Oren Ginsberg

(74) *Attorney, Agent, or Firm* — Standley Law Group LLP

(57) ABSTRACT

An exercise apparatus used for exercise and more specifically musculoskeletal physical therapy and rehabilitation purposes. The exercise apparatus particularly, but not exclusively, uses a combination of weight, a structure adapted for weight training by a person, and a means to suspend the weight wherein the suspended weight is adapted to have motion in the x, y and z axis during an exercise movement that results in increased joint strength and decreased joint pain during and after physical therapy and rehabilitation exercises.

19 Claims, 4 Drawing Sheets

EXERCISE APPARATUS FOR EXERCISING

CROSS REFERENCE TO RELATED APPLICATIONS

This application is a continuation of U.S. application Ser. No. 12/771,506 filed 30 Apr. 2010 which is a continuation of U.S. application Ser. No. 11/941,660 filed Nov. 16, 2007, the content of which are hereby incorporated by reference as if fully recited herein.

FIELD OF THE INVENTION

Exemplary embodiments of the present invention relate generally to an exercise apparatus. More specifically, exemplary embodiments of the present invention relate to exercise apparatus for musculoskeletal physical therapy and rehabilitation purposes.

BACKGROUND AND SUMMARY OF THE INVENTION

Physical therapy is an important component to restore, maintain and develop normal and healthy movement and functional ability throughout the lifespan of people and populations. As the average lifespan of humans continually increases, physical therapy is becoming more and more important in today's society as a necessary component for restoring, maintaining and developing the musculoskeletal health of persons. Physical therapy exercises strive to restore, maintain or develop an individual's optimal level of muscular strength, endurance, coordination, flexibility and/or mobility. The motivation for people to participate in physical therapy that will maintain and/or improve their movement and function may be from the process from injury, of aging or disease. Some of the main goals of physical therapy are to identify and maximize the potential ability for maximum movement in any person, within the spheres of promotion, prevention, treatment and rehabilitation.

There are many benefits from when a person enhances their muscle strength, coordination and flexibility from physical therapy. Some of the key benefits of physical therapy are: increased and maintained muscle strength and endurance, restored and increased joint range of motion, increased coordination, decreased pain, decreased muscle spasm and plasticity, decreased swelling and inflammation of joints, promoted healing of soft tissue lesions, prevented contracture and deformity of limbs, alleviated walking problems, and decreased stress. These are but a few of the benefits of physical therapy.

Consequently, it can be understood that there is a need for an improved apparatus for physical therapy and joint rehabilitation. An apparatus is needed that will allow a patient to perform multiple different exercises, where the patient experiences increased exploitation of stabilization muscles along with decreased swelling and inflammation of joints. An apparatus is further needed which is portable for ease of transportation and use. Also, an apparatus is needed that is simple to assemble as well as simple to use by a therapist or patient. Additionally, an apparatus is coveted that is aesthetically pleasing. An exemplary apparatus of the present invention may satisfy some or all of these needs.

Exemplary embodiments of the present invention particularly, but not exclusively, use a combination of weights, a structure to secure the weights thereto, and a means to suspend the weights wherein the suspended weight is adapted to have motion in the x, y, and z axis during an exercise movement that results in decreased joint pain during physical therapy and rehabilitation exercises.

Disclosed embodiments describe a rehabilitation apparatus comprising: an elongate central bar member comprised of a bendable material such as fiberglass having first and second ends, a length and a diameter of between 1 and 2 inches. a generally cylinder-shaped outer member reversibly attached to each end of the central bar member; the outer members comprised of a resilient material such as wood or fiberglass, the member having a length less than the central member, a diameter between 2 and 4 inches, and at least one weight slot, the weight slot having an open end opposite the central bar member, the slot traversing more than half the length of the outer member. And at least one elastic weight member comprising a circular elastic band and a weight through which the band is threaded; the circular elastic band having a resting diameter at least twice the diameter of the outer member; the elastic member slidably engaged with a weight slot.

Further features of examples of the invention will be described or will become apparent in the course of the following detailed description.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF THE EXEMPLARY EMBODIMENT(S)

Figure 1:
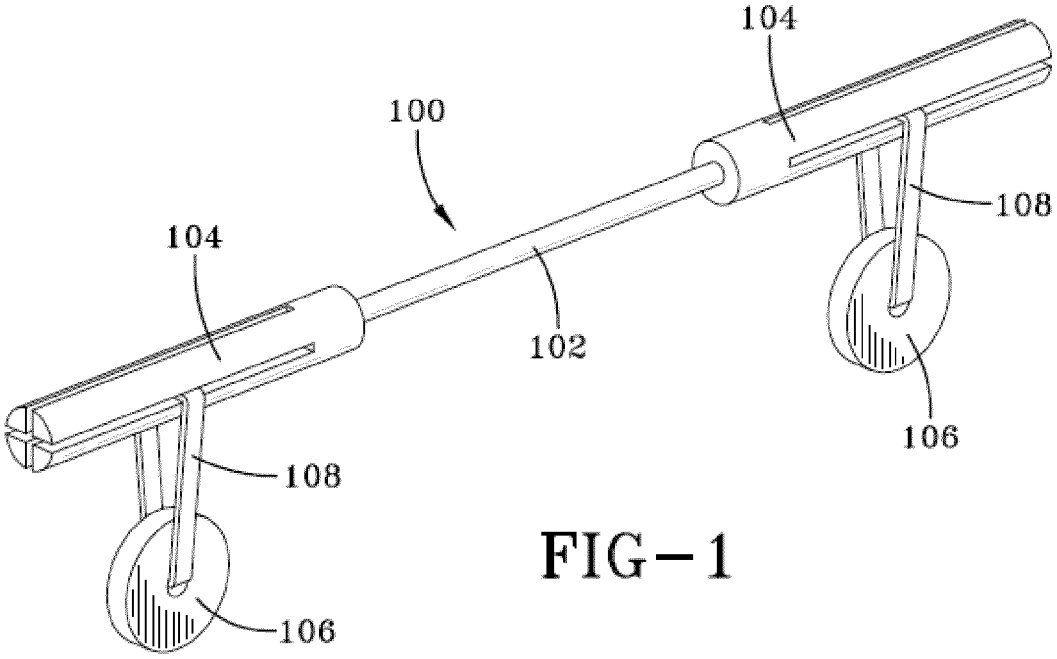
FIG. 1 is a perspective view of one of the exemplary embodiments of an exercise apparatus.

Referring to FIG. 1, here is one example of how the invention may be arranged. In FIG. 1, the apparatus is shown where there is a barbell 100 with an elongate central bar member 102 having a first diameter and cylinder-shaped outer members 104 having an outer member diameter that is larger than the diameter of the central member.

In an exemplary embodiment, the central bar member 102 of the barbell 100 is fiberglass tubing and the outer member 104 is solid wood. In other embodiments, the inner portion 102 may be made of any number of materials that are strong enough to both support tensile and compressive forces along with having lightweight, flexible and high fatigue characteristics, including, but not limited to the materials of: polyvinyl chloride, carbon fiber, wood, metals and other suitable plastics.

An object of the described embodiments is to provide an exercise apparatus that prevents a user from controlling the weight smoothly during a common exercise movement. During conventional weight bearing exercises, such as a bench press, a user is able to smoothly control the bar and weight due to the rigid nature of the metal bar and the relatively tight fit between the end of the bar and the weights. Thus, the bar, often made from metal, and the corresponding apertures in the weights are designed to keep the weights steady during a common up and down movement during a repetition of a weight-bearing exercise. This concept is distinguished by the movements created when using embodiments described herein.

In disclosed embodiments, the weights may be suspended in a variety of positions from wooden outer members by elastic bands. This unique result is furthered by the "dangling" of the weights from elastic bands rather than the rigid arrangement of conventional. During operation, the weights will naturally swing and stretch the elastic bands as the user progresses through a standard exercise motion. The bands allow the weights to move out of the normal perpendicular relationship with the floor, often swinging in chaotic arcs, all the while the user must recruit more stabilization muscles in an effort to keep the bar under control. Thus, the selection of the materials for the bar and the bands is of paramount importance. A standard metal bar will fix the center of gravity of the apparatus in the user's hands and will not bend as easily as, for example, a fiberglass central member—resulting in less translation of the desired chaotic motion. In a preferred embodiment, the central bar member is made from ⅛ inch thick fiberglass tube having an outer diameter of between 1 and 2 inches. Fiberglass has unique characteristics making it more ideal for use in this apparatus, specifically; a fiberglass central bar member has a lengthwise flexural stress value of approximately 30,000 psi, and a lengthwise flexural modulus of approximately $1.8\times10^6$ psi. Materials having a bending strength of between 25,000 and 35,000 are preferred.

In other embodiments, the outer member 104 may be made of any number of materials strong enough to support suspending the weight and also being lightweight, such as, but not limited to the materials of: fiberglass, carbon fiber, wood, metals and plastics. Keeping in mind that ideally, the total weight of the apparatus before addition of elastic weight members is preferably less than 15 pounds and more preferably less than 10 pounds.

In the embodiment shown, the outer member 104 is generally cylinder-shaped and is reversibly attached to an end of the central bar member; the outer members comprised of a resilient material such as solid wood. The member is an elongated cylinder having a length less than the central member, a diameter between 2 and 4 inches, and at least one weight slot 110, the weight slot having an open end opposite the central bar member, the slot traversing more than half the length of the outer member. In an embodiment, the outer member is approximately 13 inches in length and the weight slot is more than 10 inches in length. Optionally, the weight slot may traverse substantially the whole length of the outer member allowing for more freedom in positioning the elastic weight members.

The outer member also includes a central bar shaft (not shown). The shaft is a hollow concentric cylindrical aperture in one end of the outer member. The shaft is sized to mate snugly with the central bar. In an embodiment, the central bar shaft is approximately 2½ in length. In an optional embodiment, the shaft further includes annular channels formed within the shaft for the deposition of adhesive during assembly. Further, the outer members may be irreversibly bonded to the central bar during final assembly by means of known adhesives within the shaft.

In an embodiment an elastic weight member may be slidably engaged with the outer member 104. The weight member comprises a weight and an elastic band 108 threaded therethrough. The elastic band may be a loop of rubber with a resting diameter greater than that of the outer member. In the embodiment shown, the elastic band is a continuous loop of a highly elastic material threaded through the center of a conventional open-centered circular weight.

In one example, the overall weight of the barbell 100 is preferred to be very light compared to the mass of the elastic weight member, preferably less than 10 total pounds for a barbell of approximately 7 ft of total length. The higher the ratio of the weight mass to the barbell mass, the greater the motion produced and preferred for ideal rehabilitation/training purposes. The effect is a device that requires a great deal of stabilization due to the irregular motion generated by moving the apparatus in a rehabilitation setting. As the apparatus is lifted, the individual weights stretch their individual bands in unequal ways creating a chaotic motion that is exacerbated by further movement.

The motion produced in the x, y, and z axis may be either slight or pronounced and may appear to be chaotic, erratic or unpredictable. Various factors including the materials of the structure and means for suspending the weight, the amount of weight used, etc., may affect the amount of motion that occurs while the user moves the apparatus. However, if one skilled in the art were to have the right parameters regarding the motion of the structure from the user, the material properties, shape and size of the apparatus, etc., one skilled in the art may be able to make a close prediction of the actual motion of the apparatus that occurs.

Figure 2:
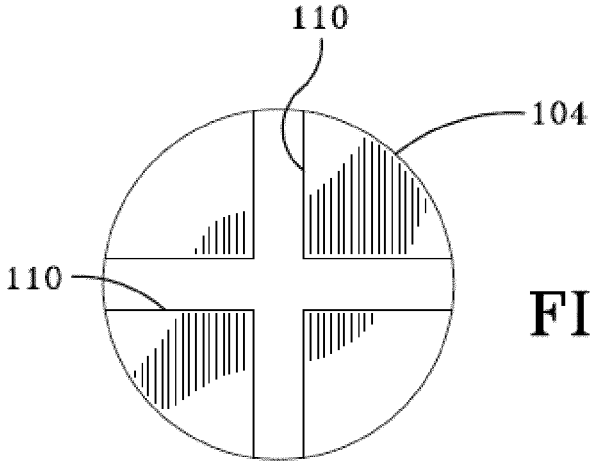
FIG. 2 is an elevate end view of one of the exemplary embodiments of an exercise apparatus.

Referring to FIGS. 1 and 2, in an exemplary embodiment, the outer portion 104 may have weight slots 110 that divide the outer member into equal quadrants. The slots 110 run from the end of the barbell 100 to a length not as long as the outer member 104. The slots 110 are large enough to allow an elastic band 108 to be slid into position in the slots 110, but still small enough to restrict the movement of the elastic band 108 after the elastic band 108 is positioned into the slots 110. In an embodiment, the weight slots have open ends opposite the central bar member, the slot traversing more than half the length of the outer member Although one embodiment uses perpendicular slots 110, this should not limit the numerous other ways that the elastic band 108 may be secured to the barbell 100 or equivalent structure. Another embodiment is where the outer member has no weight slots and the elastic band 108 is positioned directly around the outside of the outer member 104.

In an embodiment, the apparatus comprises at least one elastic weight member comprising a circular elastic band and a weight through which the band is threaded; the circular elastic band having a resting diameter at least twice the diameter of the outer member; the elastic member slidably engaged with a weight slot.

In an optional embodiment, an additional apparatus protrudes or suspends from the outer portion 104 of the barbell 100, where a C-shaped clip or other apparatus may be attached to the additional apparatus so that the elastic bands are easily secured or clipped into and out of the additional apparatus, much like a quick-release. Yet another embodiment is where the slots 110 run parallel through the outer portion 104 of the barbell 100. In other embodiments, the slots 110 may be able to pass through the barbell 100 or similar structure at many other different geometries, as long as the elastic band 108 or other means for suspending the weight 106 are able to be held within the slots 110.

Figure 4:
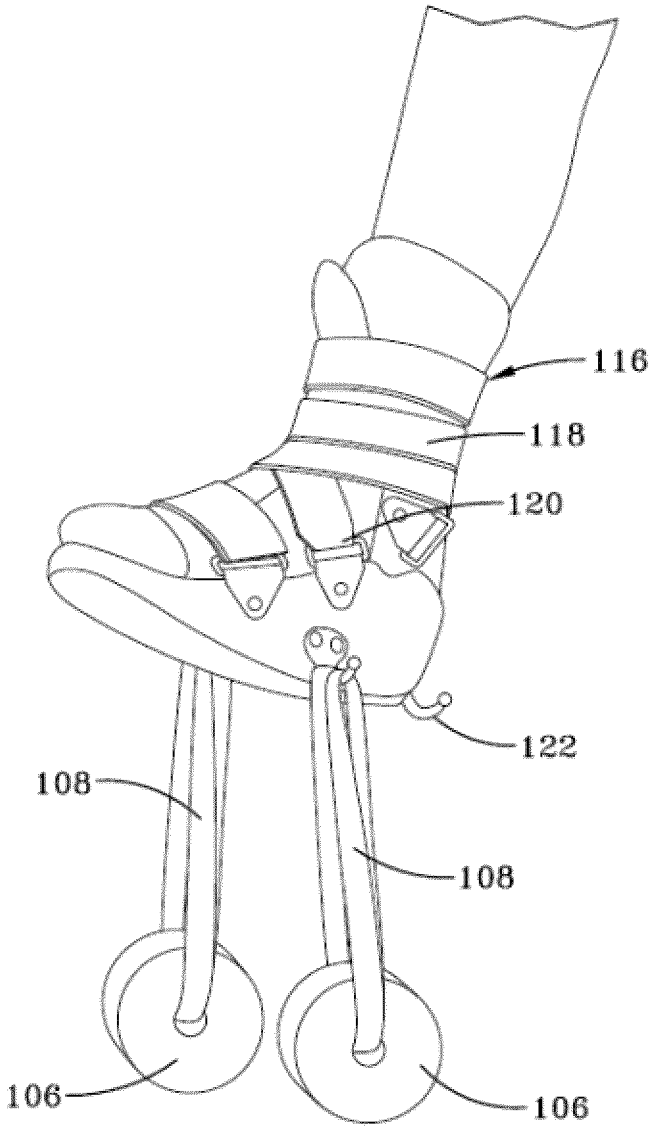
FIG. 4 is a perspective view of an alternative embodiment of the exercise apparatus.

Referring to FIG. 4, here is another example how the invention may be arranged. The lifting apparatus is shown where there is a boot 120 where a weight 106 may be securedly attached by an elastic band 108. The boot 120 securedly attaches to the user's foot and lower leg by the use of strap 118 attached to the boot. The strap 118 is placed through a fixed loop 120 located on the boot 120 and brought over upon itself and is secured with a material such as the type marketed under the trademark Velcro on the strap 118. The boot 120 may have metal protrusions 122 where the elastic band 108 is attached thereto. In other embodiments, the protrusions 122 may be made of numerous other materials.

Figure 3:
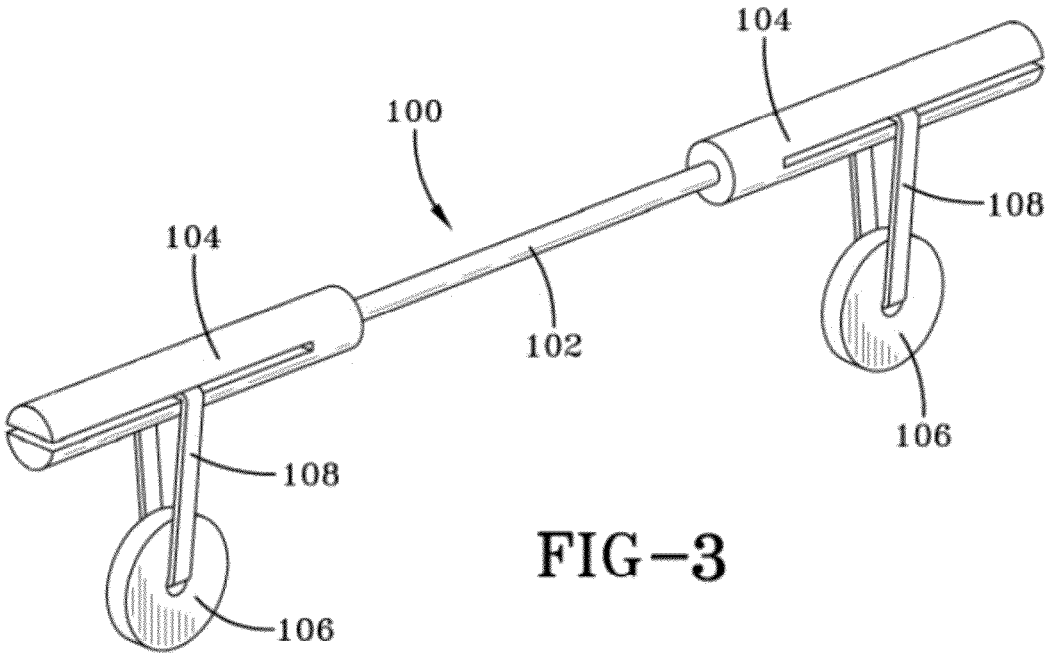
FIG. 3 is a perspective view of one of the exemplary embodiments of an exercise apparatus.

Referring to FIGS. 1 and 3, in an exemplary embodiment, the elastic band 108 may directly connect the structure to the weight 106. The elastic band 108 provides much of the motion desired from the lifting apparatus. In one commercial embodiment, the elastic band 108 used is commercially produced by Jump-Stretch Inc., found at www.jumpstretch.com. The elastic band 108 produced by Jump-Stretch Inc. used in one commercial embodiment is forty inches long and ½ inch wide. Other embodiments may use other means for suspending the weight 106 that causes a motion similar to the motion caused by a weight 106 being suspended by an elastic band 108. In one exemplary embodiment, the higher the elasticity of the means for suspending the weight, the more erratic, chaotic and unpredictable the motion produced appears and the more the motion may be preferred for ideal rehabilitation purposes because the motion increases the strength of the joint stabilizing muscles. When the motion of the apparatus discontinues, the weight 106 suspended and the elastic band 108 return to the original suspended position of the weight 106 before the motion occurred.

Referring to FIG. 1, in an exemplary embodiment, the weight 106 used is commercially available from a multitude of different vendors. One such commercial vendor is Iron Woody Fitness Equipment, found at www.ironwoodyfitness-.com. The weight 106 is preferably a commercial steel-forged plate that comes in universal sizes. The weight 106 is preferably vinyl coated for rust protection and aesthetics. Further, the weight 106 is preferably color-coordinated to indicate the mass of the weight 106. In another embodiment, the weight 106 is preferably a kettlebell that also comes in known universal sizes and may be vinyl-coated and color-coordinated. Other embodiments may use other similar or otherwise suitable weight 106.

In alternative embodiments, rather than weight slots, the outer member has a series of rings formed along its length. Each set of rings defines a weight gap therebetween. The distance between the individual rings should be such that at least 2 elastic bands may be placed in each weight gap. The rings are concentric about the center of the outer member and have a greater diameter than the outer member. In this embodiment, the diameter of the outer member need not be as large as the diameter for the previous embodiment.

Figure 5:
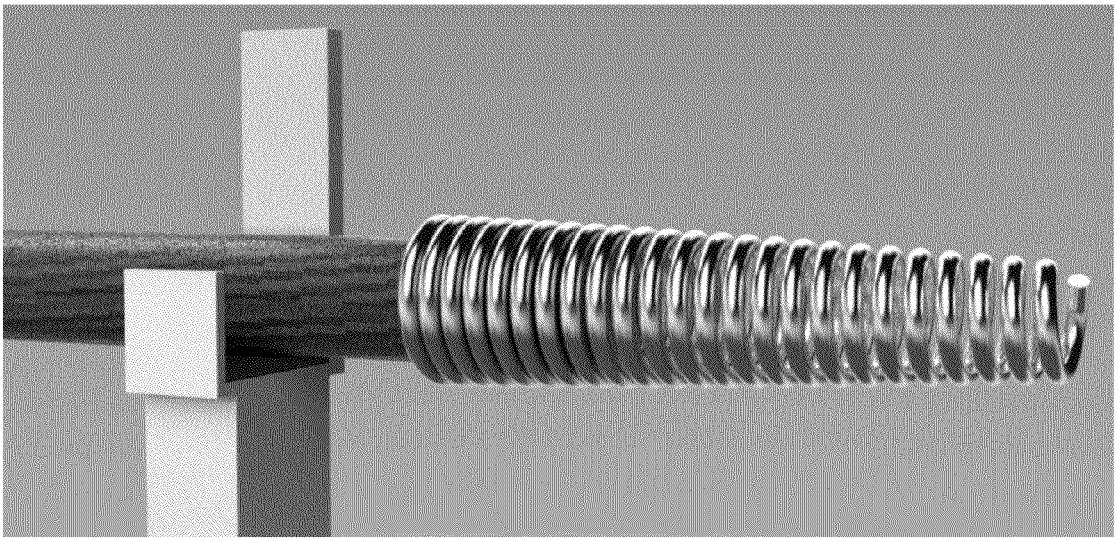
FIG. 5 is a perspective view of alternative embodiment of an outer member.

FIG. 5 shows an alternative embodiment of an outer member. The outer member is illustrated as a spring. The spring is preferably of high strength metal. The figure shows an embodiment wherein the spring tapers in circumference from the central member to an end. Alternatively, the spring may retain a uniform circumference along its length. Further, the figure shows the distance between adjacent turnings of the spring as uniform, alternatively, the spacing between adjacent turnings may be close (as shown in the figure) for a short length, perhaps 2", followed by a length of 2" wherein the distance between turnings is larger. In an embodiment, the outer member comprises a repeating pattern of 2" sections.

From the above discussion, it will be appreciated that the exemplary embodiments disclosed provide a novel apparatus used for exercising and more specifically, rehabilitation purposes. The apparatus may have many benefits. The apparatus may allow a user to perform multiple different known exercises normally used during lifting and rehabilitation. These exercises include, but are not limited to: curls, bench press, good-mornings, skull-crushers, upright rows, leg curls, leg extensions, etc. Further, the apparatus may exploit the stabilization muscles of the joints to be built up and rehabilitated which results in enhanced rehabilitation. Further, the apparatus may reduce the swelling and inflammation of the joints during and after performing the aforementioned exercises when compared to similar exercise equipment commercially available. Additionally, the apparatus may be portable for ease of transportation and use. Also, the apparatus may be simple to assemble as well as simple to use by a therapist or patient. Moreover, an example of the apparatus may be aesthetically pleasing.

While certain embodiments of the present invention are described in detail above, the scope of the invention is not to be considered limited by such disclosure, and modifications are possible without departing from the spirit of the invention as evidenced by the following claims.

What is claimed is:

1. An exercise apparatus for suspending a first and second item of weight, the apparatus comprising:

(a) an elongate central bar member formed from a first material, the bar member having a left end and a right end;

(b) a first outer weight-receiving member secured at the left end of the central bar member;

(c) a second outer weight-receiving member secured at the right end of the central bar member, the first and second outer weight-receiving members each comprised of a second material;

(d) a first elastic article adapted to be attached to said first outer weight receiving member, said first elastic article suspending the first item of weight therefrom so that it is free to move in the x, y, and z directions; and (e) a second elastic article adapted to be attached to said second outer weight receiving member, said second elastic article suspending the second item of weight therefrom so that it is free to move in the x, y, and z directions.

2. The apparatus of claim 1 wherein the first material is fiberglass.

3. The apparatus of claim 1 wherein the second material is wood.

4. The apparatus of claim 1 further comprising adhesive fastening the central bar member to the outer weight receiving members.

5. The apparatus of claim 1, wherein the second material is more flexible in bending than the first material.

6. The apparatus of claim 1, wherein said elastic articles are rubber bands.

7. The apparatus of claim 1, wherein said items of weight suspended from said elastic articles are free to move in the x, y, and z axis.

8. The apparatus of claim 1, wherein said central bar member has a bending strength of between about 25,000 and about 35,000 psi.

9. The apparatus of claim 1, wherein said elastic articles are attached through slots formed in said outer weight receiving members, said slots running parallel with said central bar member and said outer weight receiving members.

10. The apparatus of claim 1, wherein said elastic articles are elastic bands each about a half inch wide.

11. The apparatus of claim 1, wherein said outer weight receiving members are metal springs attached to said central bar member in an orientation where said springs in their resting state are substantially aligned with and in the same plane as said central bar member.

12. An exercise apparatus for suspending a first and second item of weight, the apparatus comprising:

(a) an elongate central bar member formed from a first material, the bar member having a left end and a right end;

(b) a first outer weight-receiving spring member secured at the left end of the central bar member and substantially co-linear therewith;

(c) a second outer weight-receiving spring member secured at the right end of the central bar member and substantially co-linear therewith, the first and second outer weight-receiving spring members each comprised of a second material;

(d) a first elastic rubber band adapted to be attached to said first outer weight receiving member, said first elastic rubber band suspending the first item of weight therefrom so that the first item of weight hangs freely; and (e) a second elastic rubber band adapted to be attached to said second outer weight receiving member, said second elastic rubber band suspending the second item of weight therefrom so that the second item of weight hangs freely.

13. The apparatus of claim 12 wherein said first and second spring members taper in circumference when moving outwardly away from the central bar member.

14. The apparatus of claim 12 wherein said first and second spring members have a uniform circumference along its length.

15. The apparatus of claim 12 wherein said first and second spring members are comprised of windings of high strength metal.

16. The apparatus of claim 12, wherein said items of weight suspended from said elastic rubber bands are free to move in the x, y, and z axis.

17. An exercise apparatus for use with a first and second item of weight comprising:

(a) an elongate bar member formed from a material having a bending strength between 25,000 and 35,000 psi, the bar member having a left end and a right end;

(b) a first elastic article attached to said elongate member at said left end and adapted to hang the first item of weight therefrom; and (c) a second elastic article attached to said elongate member at said right end and adapted to hang the first item of weight therefrom.

18. The exercise apparatus of claim 17 wherein the elongate bar member weighs less than fifteen pounds.

19. The exercise apparatus of claim 17 wherein the elongate bar member comprises fiberglass.

* * * * *